US007862344B2

(12) United States Patent
Morgan et al.

(10) Patent No.: US 7,862,344 B2
(45) Date of Patent: Jan. 4, 2011

(54) ELECTRICAL CONNECTOR HAVING REVERSED DIFFERENTIAL PAIRS

(75) Inventors: Chad William Morgan, Woolwich Township, NJ (US); David Wayne Helster, Dauphin, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 168 days.

(21) Appl. No.: 12/188,961

(22) Filed: Aug. 8, 2008

(65) Prior Publication Data

US 2010/0035454 A1 Feb. 11, 2010

(51) Int. Cl.
*H01R 12/00* (2006.01)

(52) U.S. Cl. ..... 439/67; 439/941; 439/607.06; 439/607.07; 439/108

(58) Field of Classification Search ..... 439/67, 439/94, 607.05–607.16, 108, 82
See application file for complete search history.

(56) References Cited

U.S. PATENT DOCUMENTS 6,554,647 B1 * 4/2003 Cohen et al. ..... 439/607.07
7,207,807 B2 4/2007 Fogg
7,255,573 B2 * 8/2007 He et al. ..... 439/66
7,309,257 B1 12/2007 Minich
2009/0068887 A1 * 3/2009 Ito ..... 439/608

FOREIGN PATENT DOCUMENTS

DE 10 2005 057 905 A1 6/2006
EP 1 347 539 A1 9/2003
WO WO 01/39332 A1 5/2001

OTHER PUBLICATIONS

International Search Report, International Application No. PCT/US2009/004398, International Filing Date Jul. 30, 2009.

* cited by examiner

*Primary Examiner*—Tho D Ta
*Assistant Examiner*—Travis Chambers

(57) ABSTRACT

A contact module is provided for an electrical connector. The contact module includes a body having a mating edge portion and a mounting edge portion. A lead frame is held by the body. The lead frame includes a differential pair of terminals extending between the mating edge portion and the mounting edge portion. The differential pair includes a positive terminal and a negative terminal having positive and negative mating contacts, respectively, and positive and negative mounting contacts, respectively. The positive and negative mating contacts extend from the mating edge portion in a first orientation. The positive and negative mounting contacts extend from the mounting edge portion in a second orientation. The first orientation at the mating edge portion is inverted relative to the second orientation at the mounting edge portion.

20 Claims, 7 Drawing Sheets

ELECTRICAL CONNECTOR HAVING REVERSED DIFFERENTIAL PAIRS

BACKGROUND OF THE INVENTION

The subject matter described and/or illustrated herein relates generally to electrical connectors and, more particularly, to electrical connectors that interconnect circuit boards.

Electrical connectors that interconnect two circuit boards typically include mating contacts that electrically connect to one of the circuit boards and mounting contacts that connect to the other circuit board. Specifically, the mounting contacts are commonly received within vias of the corresponding circuit board, while the mating contacts engage electrical contacts extending from the corresponding circuit board or an intervening header connector. The patterns of vias and electrical contacts of the circuit board are sometimes referred to as a "footprint" of the circuit board.

To meet digital multi-media demands, higher data throughput is often desired for current digital communications equipment. Current digital communications equipment may therefore attempt to increase signal speed, signal density, and/or electrical performance while maintaining reasonable cost. Electrical connectors that interconnect circuit boards must therefore handle ever increasing signal speeds at ever increasing signal densities. However, increasing signal speed and density may conflict with improving electrical signal performance. For example, increasing signal speed and/or density may introduce more signal noise, commonly referred to as crosstalk.

Crosstalk often occurs at the footprints of the circuit boards. Specifically, crosstalk may occur between adjacent vias or electrical contacts of the circuit boards that are engaged with the mating and mounting contacts of the electrical connector. For example, when a driven signal enters the receiving via of a other circuit board, cross talk may occur between the receiving via and one or more adjacent vias of the other circuit board. If the crosstalk then propagates in the same direction as the driven signal, the crosstalk is commonly referred to as "far-end crosstalk". Far-end crosstalk that occurs at the footprint of a circuit board may be difficult to reduce. For example, known methods for reducing far-end crosstalk at the circuit board footprints may reduce impedance, decrease signal density, and/or increase cost.

A need remains for an electrical interconnection that reduces total far-end crosstalk generated by two footprints on each side of a connector without reducing impedance, decreasing signal density, and/or increasing cost of either footprint alone.

BRIEF DESCRIPTION OF THE INVENTION

In one embodiment, a contact module is provided for an electrical connector. The contact module includes a body having a mating edge portion and a mounting edge portion. A lead frame is held by the body. The lead frame includes a differential pair of terminals extending between the mating edge portion and the mounting edge portion. The differential pair includes a positive terminal and a negative terminal having positive and negative mating contacts, respectively, and positive and negative mounting contacts, respectively. The positive and negative mating contacts extend from the mating edge portion in a first orientation. The positive and negative mounting contacts extend from the mounting edge portion in a second orientation. The first orientation at the mating edge portion is inverted relative to the second orientation at the mounting edge portion.

In another embodiment, an electrical connector is provided. The electrical connector includes a housing having a mating face and a mounting face. A differential pair of terminals extends between the mating face and the mounting face. The differential pair includes a positive terminal and a negative terminal having positive and negative mating contacts, respectively, and positive and negative mounting contacts, respectively. The positive and negative mating contacts extend from the mating face in a first orientation. The positive and negative mounting contacts extend from the mounting face in a second orientation. The first orientation at the mating face is inverted relative to the second orientation at the mounting face.

DETAILED DESCRIPTION OF THE INVENTION

Figure 1:
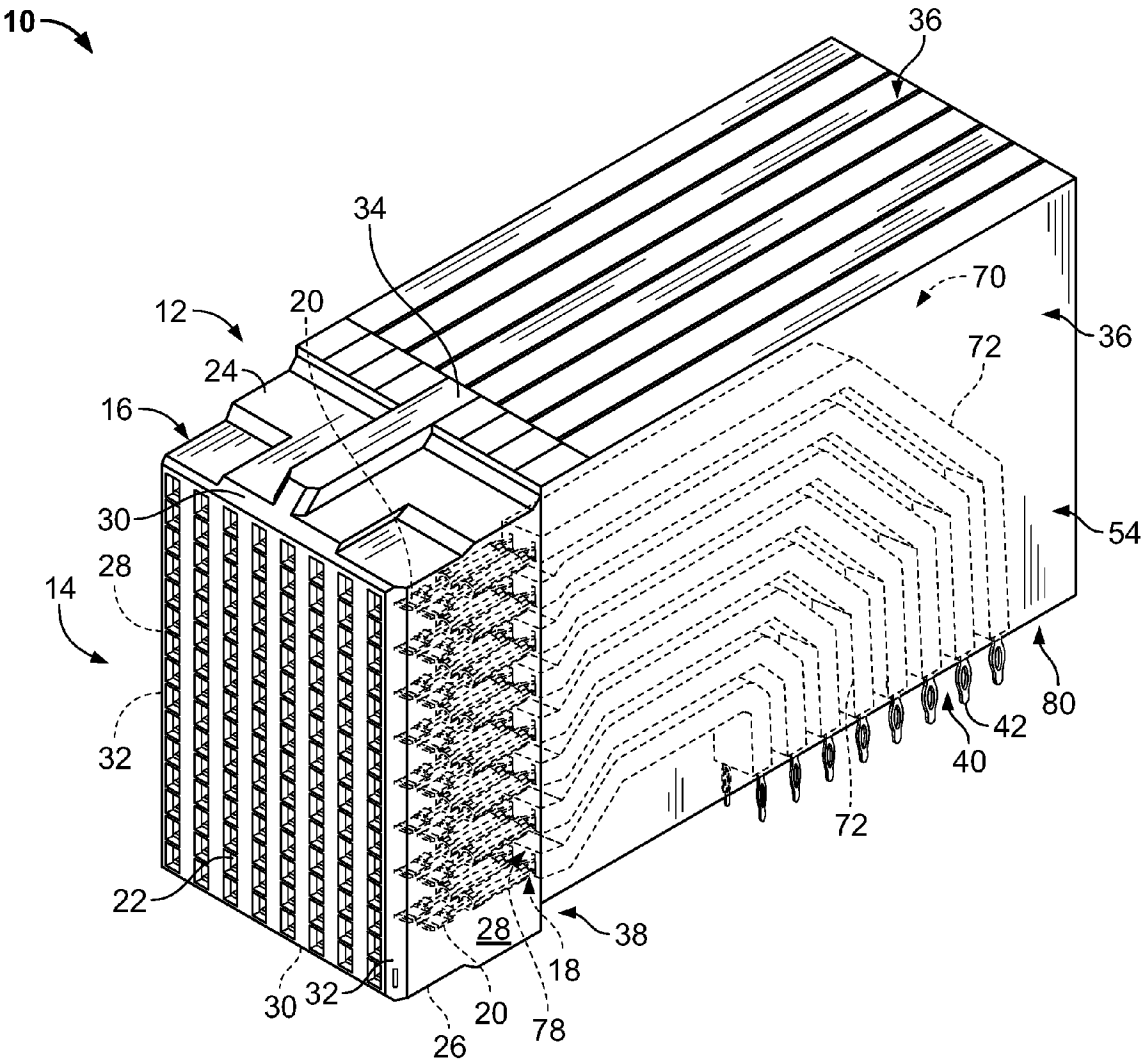
FIG. 1 is a perspective view of an exemplary embodiment of an electrical connector.

FIG. 1 is a perspective view of an exemplary embodiment of an electrical connector 10 for interconnecting electrical components (not shown), such as, but not limited to, two circuit boards. The connector 10 includes a dielectric housing 12 having a forward mating end 14 that includes a shroud 16 and a mating face 18. The mating face 18 includes a plurality of mating contacts 20 arranged along the mating face 18, such as, but not limited to, contacts within contact cavities 22, that are configured to receive corresponding mating contacts (not shown) from a mating connector (not shown) that may be, for example, mounted on a circuit board. The shroud 16 includes an upper surface 24 and a lower surface 26 between opposite sides 28. The upper and lower surfaces 24 and 26, respectively, each includes an optional chamfered forward edge portion 30. The sides 28 each include optional chamfered side edge portions 32. Optionally, an alignment rib 34 is formed on the upper shroud surface 24 and lower shroud surface 26. The chamfered edge portions 30 and 32 and the alignment ribs 34 cooperate to bring the connector 10 into alignment with the mating connector during the mating process so that the contacts in the mating connector are received in the contact cavities 22 without damage.

A plurality of contact modules 36 are received in the housing 12 from a rearward end 38. The contact modules 36 define a connector mounting face 40. A combination of the housing 12 and a dielectric body 54 of each of the contact modules 36 may be referred to herein as a "housing" of the electrical connector 10, wherein the "housing" includes the mounting face 40. The connector mounting face 40 includes a plurality of mounting contacts 42 arranged therealong. The mounting contacts 42 are configured to be mounted to a substrate (not shown), such as, but not limited to, a circuit board. In the exemplary embodiment, the mounting face 40 is approximately perpendicular to the mating face 18 such that the connector 10 interconnects electrical components that are approximately at a right angle to one another. However, the mounting face 40 may be angled at any other suitable angle relative to the mating face 18 that enables the connector 10 to interconnect electrical components that are oriented at any other angle relative to each other. Although seven are shown, the housing 12 may hold any number of contact modules 36 overall. Each contact module 36 have any number of the mating contacts 20 and any number of the mounting contacts 42.

Figure 2:
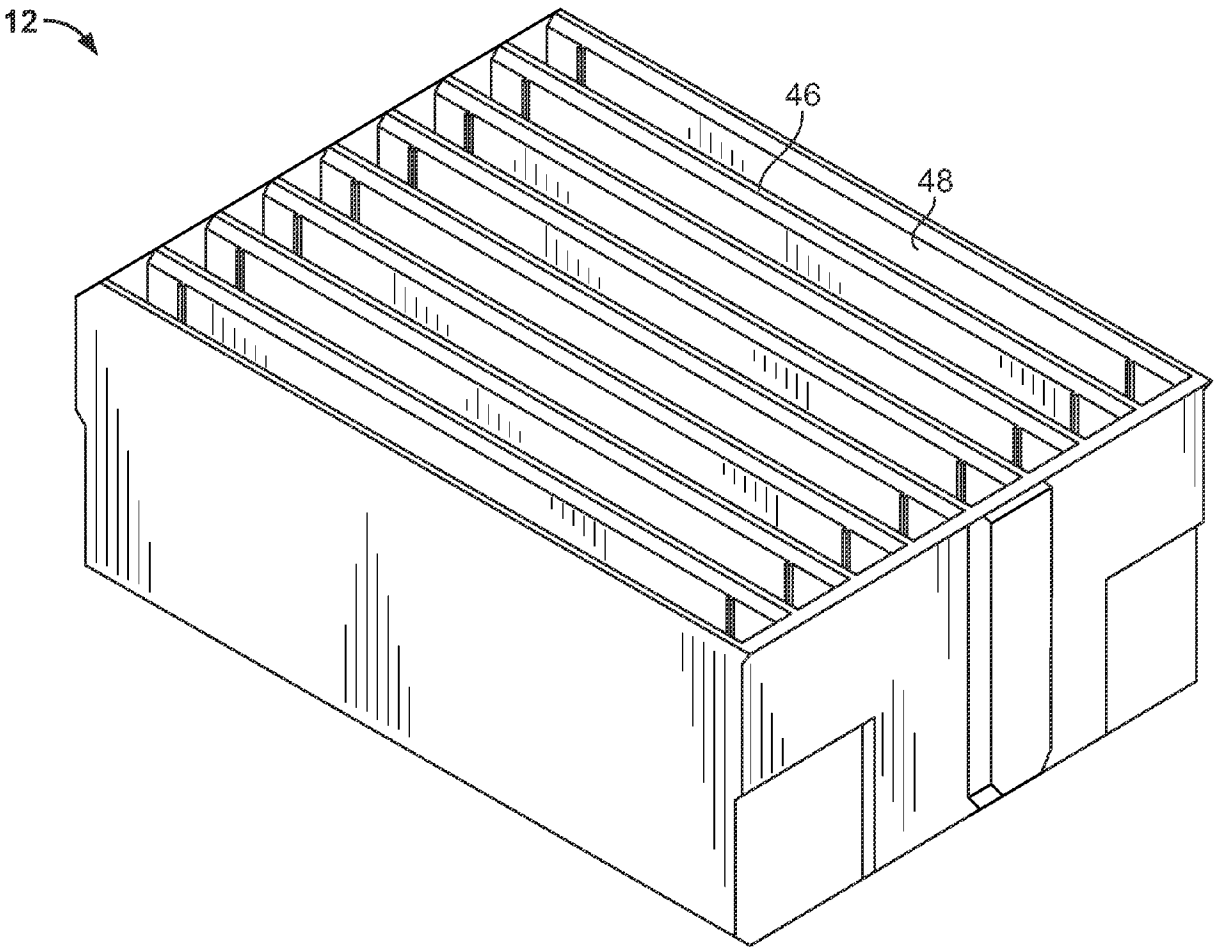
FIG. 2 is a perspective view of an exemplary embodiment of a housing of the electrical connector shown in FIG. 1.
Figure 3:
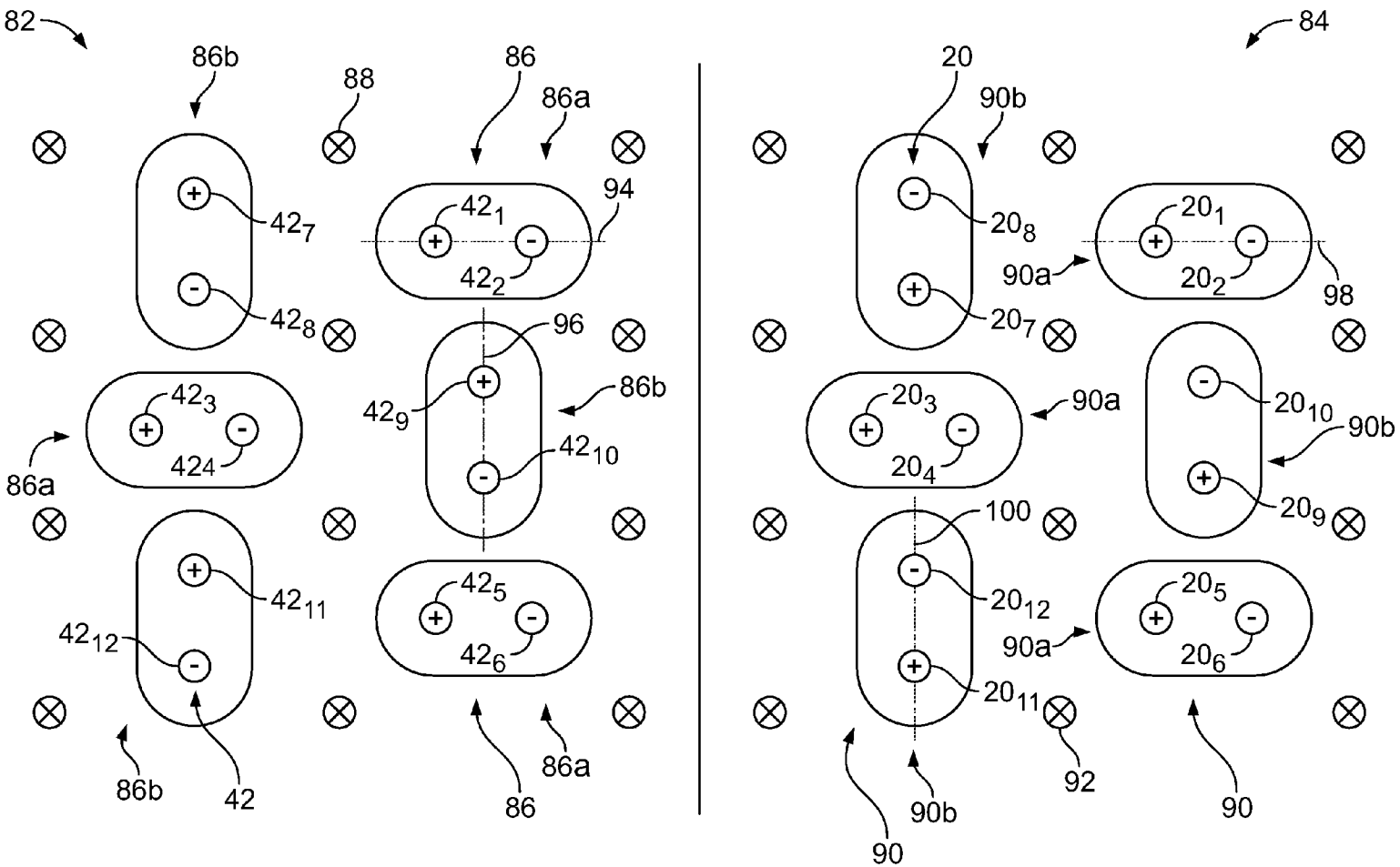
FIG. 3 is a plan view illustrating an exemplary embodiment of patterns of mounting contacts and mating contacts of the connector shown in FIG. 1.
Figure 4:
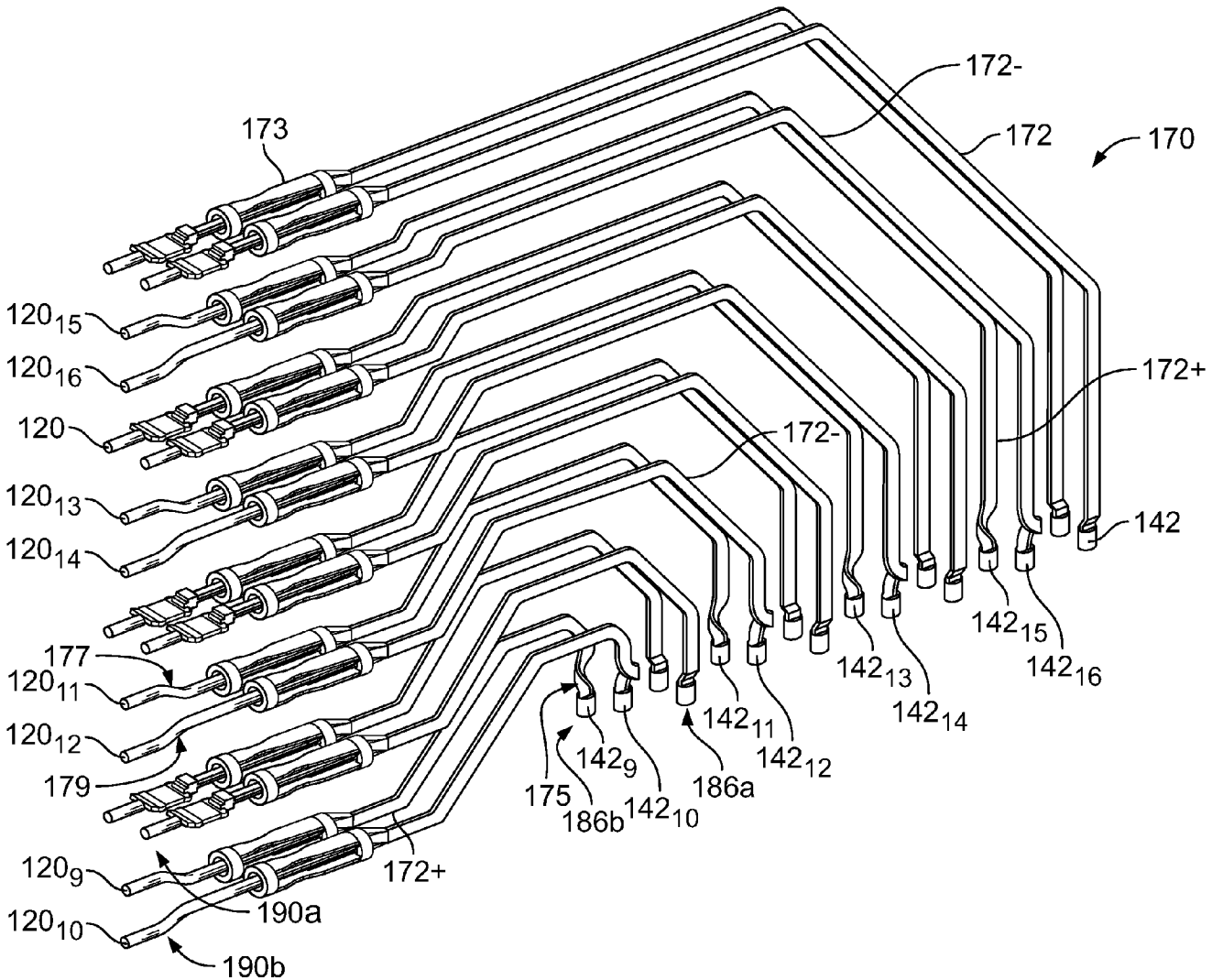
FIG. 4 is a perspective view of an exemplary embodiment of a lead frame of a contact module for use generating the pattern shown in FIG. 3.

FIG. 2 is a perspective view of the housing 12. The housing 12 includes a plurality of dividing walls 46 that define a plurality of chambers 48. The chambers 48 receive a forward portion of the contact modules 36 (FIGS. 1, 3, and 4). The chambers 48 stabilize the contact modules 36 when the contact modules 36 are loaded into the housing 12. In the exemplary embodiment, the chambers 48 each have about an equal width. However, one or more of the chambers 48 may different widths for accommodating differently sized contact modules 36.

Referring again to FIG. 1, each contact module 36 includes a lead frame 70 that includes a plurality of electrical terminals 72. The terminals 72 extend along predetermined paths to electrically connect each mating contact 20 with each mounting contact 42. Each terminal 72 may be either a signal terminal, a ground terminal, or a power terminal. As will be described and illustrated below, in the exemplary embodiment the terminals 72 are arranged in differential pairs. The lead frame 70 is encased, or surrounded, in a dielectric body 54. In the exemplary embodiment, the body 54 extends between a mating edge portion 78 and a mounting edge portion 80 that defines a portion of the mounting face 40. The mating contacts 20 extend from the mating edge portion 78 of the body 54 and the mounting contacts 42 extend from the mounting edge portion 80 of the body 54. In the exemplary embodiment, the mounting edge portion 80 is approximately perpendicular to the mating edge portion 78 such that the connector 10 interconnects electrical components that are approximately at a right angle to one another. However, the mounting edge portion 80 may be angled at any other suitable angle relative to the mating edge portion 78 that enables the connector 10 to interconnect electrical components that are oriented at any other angle relative to each other.

In alternative to the plurality of contact modules 36 held by the housing 12, the lead frames 70 of the receptacle connector 10 may be held by a single housing (not shown), which may be integral with, or alternatively held by, the housing 12.

FIG. 3 is a plan view illustrating an exemplary embodiment of a pattern 82 of the mounting contacts 42 along the mounting face 40 of the connector 10 (FIG. 1) and a pattern 84 of the mating contacts 20 along the mating face 18 of the connector 10. The pattern 82 matches the pattern (not shown) of a plurality of vias (not shown) or electrical contacts (not shown) of the electrical component (not shown) electrically connected to the mounting contacts 42. Similarly, the pattern 84 matches the pattern (not shown) of a plurality of vias (not shown) or electrical contacts (not shown) of the electrical component (not shown) electrically connected to the mating contacts 20. The pattern 82 includes a plurality of the mounting contacts 42 arranged in differential pairs 86. The differential pairs 86 of mounting contacts 42 are arranged in columns that are separated by ground contacts 88. Likewise, the pattern 84 includes a plurality of the mating contacts 20 arranged in differential pairs 90. The differential pairs 90 of mating contacts 20 are arranged in columns that are separated by ground contacts 92. Each mounting contact $\mathbf{42}_{1\text{-}12}$ within the pattern 82 is electrically connected to a respective one of the mating contacts $\mathbf{20}_{1\text{-}12}$ within the pattern 84 via a corresponding terminal 72 (not shown in FIG. 3).

Within each differential pair 86 of mounting contacts 42, one of the two corresponding terminals 72 is selected as a positive terminal 72 while the other terminal 72 is selected as a negative terminal 72. Accordingly, within each differential pair 86 of the mounting contacts 42, one of the mounting contacts 42 is a positive mounting contact 42 while the other is a negative mounting contact 42. Similarly, within each differential pair 90 of mating contacts 20, the mating contact 20 connected to the corresponding positive terminal 72 is a positive mating contact 20 while the mating contact 20 connected to the corresponding negative terminal 72 is a negative mating contact 20.

The pattern 82 of the differential pairs 86 of mounting contacts 42 includes two different groups 86*a* and 86*b* of differential pairs 86. The positive and negative mounting contacts 42 of each differential pair 86 within the group 86*a* are aligned along a line 94, while the positive and negative mounting contacts 42 of each differential pair 86 within the group 86*b* are aligned along a line 96. As can be seen in FIG. 3, the lines 94 of the differential pair group 86*a* extend parallel to one another, as do each of the lines 96 of the differential pair group 86*b*. However, each of the lines 94 is approximately perpendicular to the each of the lines 96 such that the positive and negative mounting contacts 42 of each differential pair 86 within the group 86*a* are aligned approximately perpendicular to the positive and negative mounting contacts 42 of each differential pair within the group 86*b*. Accordingly, each of the differential pairs 86 within the differential pair group 86*a* is aligned approximately perpendicular to each of the differential pairs 86 within the differential pair group 86*b*.

The pattern 84 of the differential pairs 90 of mating contacts 20 includes two different groups 90*a* and 90*b* of differential pairs 90. The positive and negative mating contacts 20 of each differential pair 90 within the group 90*a* are aligned along a line 98, while the positive and negative mating contacts 20 of each differential pair 90 within the group 90*b* are aligned along a line 100. As can be seen in FIG. 3, the lines 98 of the differential pair group 90*a* extend parallel to one another, as do each of the lines 100 of the differential pair group 90*b*. However, each of the lines 98 is approximately perpendicular to the each of the lines 100 such that the positive and negative mating contacts 20 of each differential pair 90 within the group 90*a* are aligned approximately perpendicular to the positive and negative mating contacts 20 of each differential pair within the group 90*b*. Accordingly, each of the differential pairs 90 within the differential pair group 90*a* is aligned approximately perpendicular to each of the differential pairs 90 within the differential pair group 90*b*.

Each differential pair 86 of mounting contacts 42 within the group 86*a* has a common orientation along the mounting face 40 with the corresponding differential pair 90 of mating contacts 20 within the group 90*a* has along the mating face 18. In other words, if the patterns 82 and 84 are overlaid, the positive and negative mounting contacts 42 of each differential pair 86 within the group 86*a* will have a common orientation with the positive and negative mating contacts 20 of the corresponding differential pair 90 within the group 90*a*. Specifically, the positive mounting contact $\mathbf{42}_1$ and the negative mounting contact $\mathbf{42}_2$ have a common orientation along the mounting face 40 with the positive mating contact $\mathbf{20}_1$ and the negative mating contact $\mathbf{20}_2$ along the mating face 18, the positive mounting contact $\mathbf{42}_3$ and the negative mounting contact $\mathbf{42}_4$ have a common orientation along the mounting face 40 with the positive mating contact $\mathbf{20}_3$ and the negative mating contact $\mathbf{20}_4$ along the mating face 18, and the positive mounting contact $\mathbf{42}_5$ and the negative mounting contact $\mathbf{42}_6$ have a common orientation along the mounting face 40 with the positive mating contact $\mathbf{20}_5$ and the negative mating contact $\mathbf{20}_6$ along the mating face 18.

Each differential pair 86 of mounting contacts 42 within the group 86*b* has a different orientation along the mounting face 40 than the corresponding differential pair 90 of mating contacts 20 within the group 90*b* has along the mating face 18. Specifically, the orientation of the positive and negative mounting contacts 42 of each differential pair 86 within the group 86*b* is inverted approximately 180° relative to the positive and negative mating contacts 20 of the corresponding differential pair 90 within the group 90*b*. In the exemplary embodiment, the orientation of the positive mounting contact $\mathbf{42}_7$ and the negative mounting contact $\mathbf{42}_8$ along the mounting face 40 is inverted relative to the orientation of the positive mating contact $\mathbf{20}_7$ and the negative mating contact $\mathbf{20}_8$ along the mating face 18, the orientation of the positive mounting contact $\mathbf{42}_9$ and the negative mounting contact $\mathbf{42}_{10}$ along the mounting face 40 is inverted relative to the orientation of the positive mating contact $\mathbf{20}_9$ and the negative mating contact $\mathbf{20}_{10}$ along the mating face 18, and the orientation of the positive mounting contact $\mathbf{42}_{11}$ and the negative mounting contact $\mathbf{42}_{12}$ along the mounting face 40 is inverted relative to the orientation of the positive mating contact $\mathbf{20}_{11}$ and the negative mating contact $\mathbf{20}_{12}$ along the mating face 18. Inverting the orientation of the differential pairs 86 within the group 86*b* on the mounting face 40 relative to the corresponding differential pairs 90 within the group 90*b* on the mating face 18 may facilitate reducing overall far-end crosstalk generated by the two footprints on either side of the electrical connector 10.

FIG. 4 is a perspective view of an exemplary embodiment of a lead frame 170 that may be used with one of the contact modules 36 to generate patterns similar to the patterns 82 and 84 (FIG. 3). The lead frame 170 includes a plurality of mounting contacts 142, a plurality of the mating contacts 120, and a plurality of terminals 172. Each terminal 172 interconnects a mounting contact 142 with the corresponding mating contact 120. Each of the mating contacts 120 is optionally connected to the corresponding terminal 172 via a connector 173, as shown in the exemplary embodiment of FIG. 4. Similarly, each of the mounting contacts 142 is optionally connected to the corresponding terminal 172 via a connector (not shown).

The terminals 172 are arranged in differential pairs. Accordingly, the mounting and mating contacts 142 and 120, respectively, are arranged in differential pairs 186 and 190, respectively. Within each differential pair, one terminal 172 is selected as a positive terminal 172 while the other terminal 172 is selected as a negative terminal 172. Accordingly, within each differential pair 186, one mounting contacts 142 is a positive mounting contact 142 while the other is a negative mounting contact 142. Similarly, within each differential pair 190, one mating contact 120 is a positive mating contact 120 while the other is a negative mating contact 120. The differential pairs 186 of mounting contacts 142 include two different groups 186*a* and 186*b* of differential pairs 186. As can be seen in FIG. 4, each of the differential pairs 186 within the differential pair group 186*a* is aligned approximately perpendicular to each of the differential pairs 186 within the differential pair group 186*b*. The differential pairs 190 of mating contacts 120 include two different groups 190*a* and 190*b* of differential pairs 190. Each of the differential pairs 190 within the differential pair group 190*a* is aligned approximately perpendicular to each of the differential pairs 190 within the differential pair group 190*b*.

Each differential pair 186 of mounting contacts 142 within the group 186*a* has a common orientation with the corresponding differential pair 190 of mating contacts 120 within the group 190*a*. However, each differential pair 186 of mounting contacts 142 within the group 186*b* has a different orientation than the corresponding differential pair 190 of mating contacts 120 within the group 190*b*. Specifically, the orientation of the positive and negative mounting contacts 142 of each differential pair 186 within the group 186*b* is inverted relative to the positive and negative mating contacts 120 of the corresponding differential pair 190 within the group 190*b*. In the exemplary embodiment, the orientation of the positive mounting contact $\mathbf{142}_9$ and the negative mounting contact $\mathbf{142}_{10}$ is inverted relative to the orientation of the positive mating contact $\mathbf{120}_9$ and the negative mating contact $\mathbf{120}_{10}$, the orientation of the positive mounting contact $\mathbf{142}_{11}$ and the negative mounting contact $\mathbf{142}_{12}$ is inverted relative to the orientation of the positive mating contact $\mathbf{120}_{11}$ and the negative mating contact $\mathbf{120}_{12}$, the orientation of the positive mounting contact $\mathbf{142}_{13}$ and the negative mounting contact $\mathbf{142}_{14}$ is inverted relative to the orientation of the positive mating contact $\mathbf{120}_{13}$ and the negative mating contact $\mathbf{120}_{14}$, and the orientation of the positive mounting contact $\mathbf{142}_{15}$ and the negative mounting contact $\mathbf{142}_{16}$ is inverted relative to the orientation of the positive mating contact $\mathbf{120}_{15}$ and the negative mating contact $\mathbf{120}_{16}$.

The mounting contacts 142, the mating contacts 120, and/or the terminals 172 of the differential pair group 186*b* include geometry that provides the corresponding mounting contacts 142 and mating contacts 120 of the differential pair group 186*b* with the inverted orientation. For example, in the exemplary embodiment, a positive terminal 172+ of each differential pair of the group 186*b* includes an angled portion 175 adjacent the corresponding mounting contact 142 and an angled portion 177 adjacent the corresponding mating contact 120 that each facilitate the inverted orientation. Moreover, in the exemplary embodiment, a negative terminal 172– of each differential pair of the group 186*b* includes an angled portion 179 adjacent the corresponding mating contact 120 that facilitates the inverted orientation. However, any of the mating contacts 120, the mounting contacts 142, and/or the terminals 172 (whether positive and/or negative) may include the geometry that facilitates providing the inverted orientation. Moreover, the geometry that facilitates providing the inverted orientation may be at any location(s) along the mating contacts 120, the mounting contacts 142, and/or the terminals 172 that enables the inverted orientation.

Figure 5:
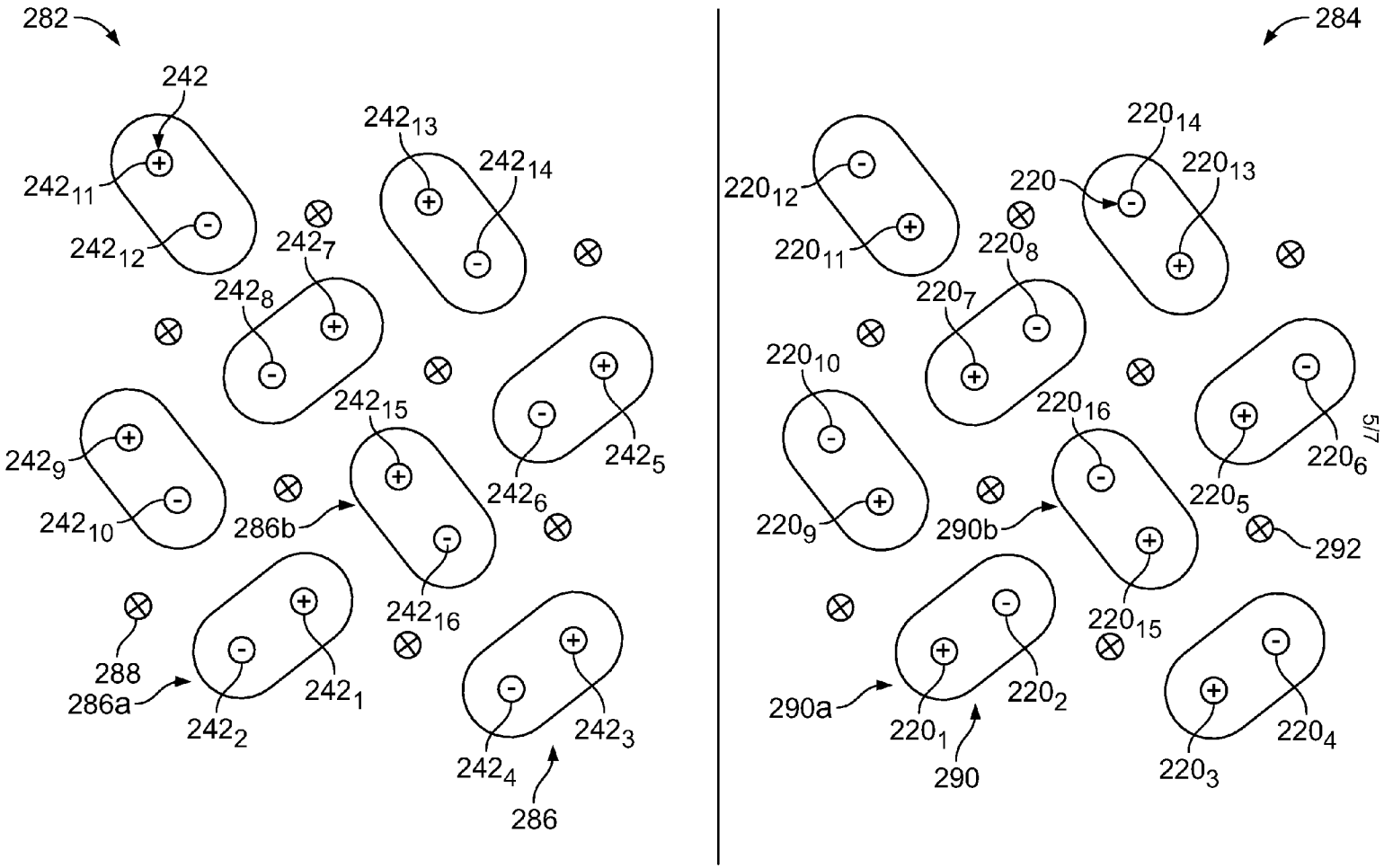
FIG. 5 is a plan view illustrating another exemplary embodiment of patterns of mounting contacts and mating contacts of the connector shown in FIG. 1.

FIG. 5 is a plan view illustrating an exemplary embodiment of a pattern 282 of mounting contacts 242 that may extend from the mounting face 40 of the connector 10 (FIG. 1) and a pattern 284 of mating contacts 220 that may extend from the mating face 18 of the connector 10. The pattern 282 matches the pattern (not shown) of a plurality of vias (not shown) or electrical contacts (not shown) of the electrical component (not shown) electrically connected to the mounting contacts 242. Similarly, the pattern 284 matches the pattern (not shown) of a plurality of vias (not shown) or electrical contacts (not shown) of the electrical component (not shown) electrically connected to the mating contacts 220. The pattern 282 includes a plurality of the mounting contacts 242 arranged in differential pairs 286. Likewise, the pattern 284 includes a plurality of the mating contacts 220 arranged in differential pairs 290. Each mounting contact $242_{1-16}$ within the pattern 282 is electrically connected to a respective one of the mating contacts $220_{1-16}$ within the pattern 284 via a corresponding terminal (not shown). Within each differential pair 286 of the mounting contacts 242, one of the mounting contacts 242 is a positive mounting contact 242 while the other is a negative mounting contact 242. Similarly, within each differential pair 290 of mating contacts 220, one of the mating contacts 220 is a positive mating contact 220 while the other mating contact 220 is a negative mating contact 220.

The pattern 282 of the differential pairs 286 of mounting contacts 242 includes two different groups 286*a* and 286*b* of differential pairs 286. Each of the differential pairs 286 within the differential pair group 286*a* is aligned approximately perpendicular to each of the differential pairs 286 within the differential pair group 286*b*. Similarly, the pattern 284 of the differential pairs 290 of mating contacts 220 includes two different groups 290*a* and 290*b* of differential pairs 290. Each of the differential pairs 290 within the differential pair group 290*a* is aligned approximately perpendicular to each of the differential pairs 290 within the differential pair group 290*b*.

As can be seen in FIG. 5, the orientation of the positive and negative mounting contacts 242 of each differential pair 286 within the group 286*b* is inverted relative to the positive and negative mating contacts 220 of the corresponding differential pair 290 within the group 290*b*. Similarly, the orientation of the positive and negative mounting contacts 242 of each differential pair 286 within the group 286*a* is inverted relative to the positive and negative mating contacts 220 of the corresponding differential pair 290 within the group 290*a*.

Figure 6:
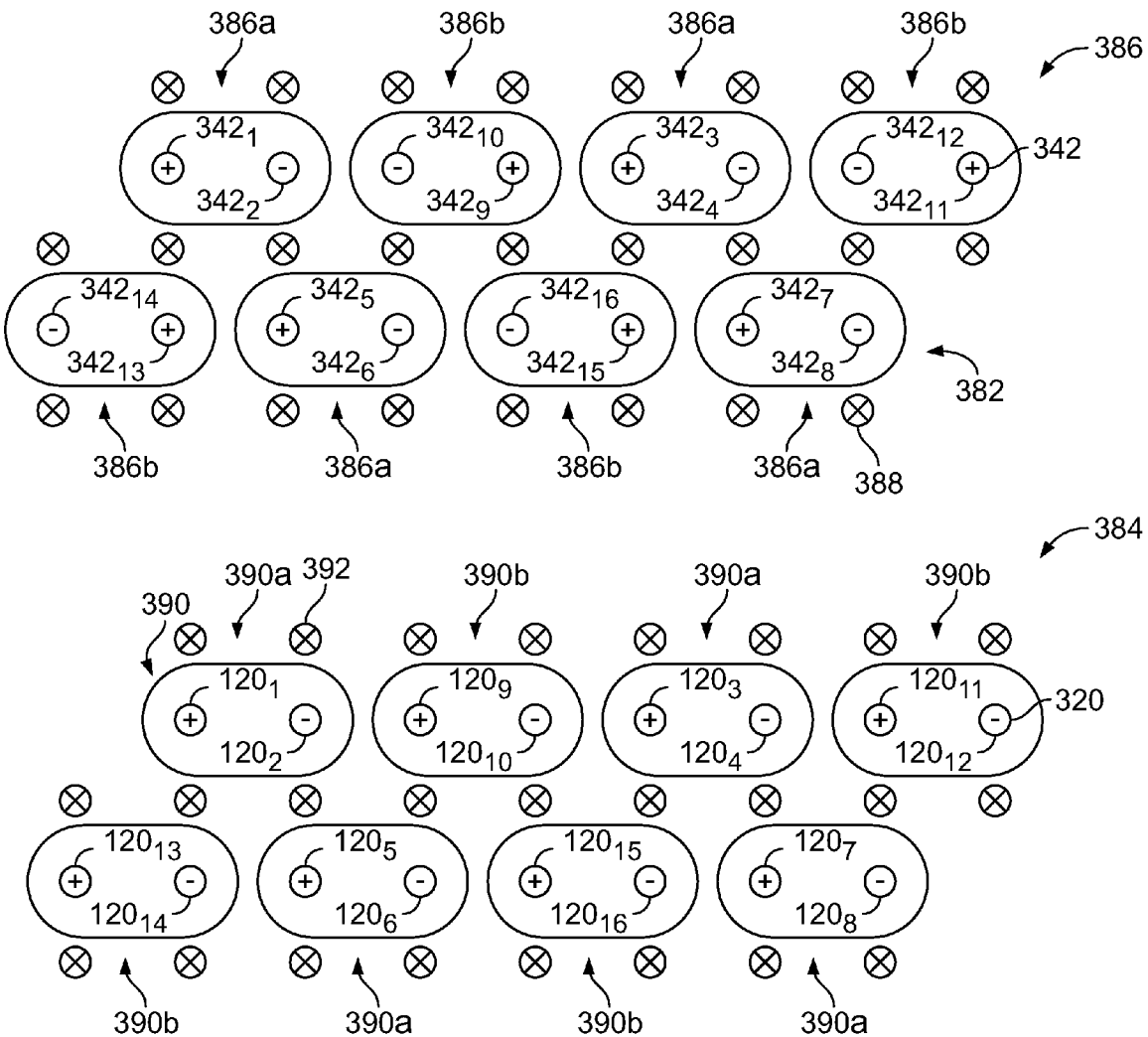
FIG. 6 is a plan view illustrating another exemplary embodiment of patterns of mounting contacts and mating contacts of the connector shown in FIG. 1.

FIG. 6 is a plan view illustrating an exemplary embodiment of a pattern 382 of mounting contacts 342 that may extend from the mounting face 40 of the connector 10 (FIG. 1) and a pattern 384 of mating contacts 320 that may extend from the mating face 18 of the connector 10. The pattern 382 matches the pattern (not shown) of a plurality of vias (not shown) or electrical contacts (not shown) of the electrical component (not shown) electrically connected to the mounting contacts 342. Similarly, the pattern 384 matches the pattern (not shown) of a plurality of vias (not shown) or electrical contacts (not shown) of the electrical component (not shown) electrically connected to the mating contacts 320. The pattern 382 includes a plurality of the mounting contacts 342 arranged in differential pairs 386. The differential pairs 386 of the mounting contacts 342 are arranged in rows that are separated by ground contacts 388. Likewise, the pattern 384 includes a plurality of the mating contacts 320 arranged in differential pairs 390. The differential pairs 390 of mating contacts 320 are arranged in rows that are separated by ground contacts 392. Each mounting contact $342_{1-16}$ within the pattern 382 is electrically connected to a respective one of the mating contacts $320_{1-16}$ within the pattern 384 via a corresponding terminal (not shown). Within each differential pair 386 of the mounting contacts 342, one of the mounting contacts 342 is a positive mounting contact 342 while the other is a negative mounting contact 342. Similarly, within each differential pair 390 of mating contacts 320, one of the mating contacts 320 is a positive mating contact 320 while the other mating contact 320 is a negative mating contact 320.

The pattern 382 of the differential pairs 386 of mounting contacts 342 includes two different groups 386*a* and 386*b* of differential pairs 386. Each of the differential pairs 386 within the differential pair group 386*a* is aligned approximately parallel to each of the differential pairs 386 within the differential pair group 386*b*. Similarly, the pattern 384 of the differential pairs 390 of mating contacts 320 includes two different groups 390*a* and 390*b* of differential pairs 390. Each of the differential pairs 390 within the differential pair group 390*a* is aligned approximately parallel to each of the differential pairs 390 within the differential pair group 390*b*.

Each differential pair 386 of mounting contacts 342 within the group 386*a* has a common orientation with the corresponding differential pair 390 of mating contacts 320 within the group 390*a*. In other words, if the patterns 382 and 384 are overlaid, the positive and negative mounting contacts 342 of each differential pair 386 within the group 386*a* will have a common orientation with the positive and negative mating contacts 320 of the corresponding differential pair 390 within the group 390*a*. However, the orientation of the positive and negative mounting contacts 342 of each differential pair 386 within the group 386*b* is inverted relative to the positive and negative mating contacts 320 of the corresponding differential pair 390 within the group 390*b*. Similarly, the orientation of the positive and negative mounting contacts 342 of each differential pair 386 within the group 386*a* is inverted relative to the positive and negative mating contacts 320 of the corresponding differential pair 390 within the group 390*a*.

While the connector 10 is described and illustrated herein with particular reference to a receptacle connector, it is to be understood that the benefits herein described are also applicable to other connectors in other embodiments. The description and illustration herein is therefore provided for purposes of illustration, rather than limitation, and is but one potential application of the subject matter described and/or illustrated herein.

Figure 7:
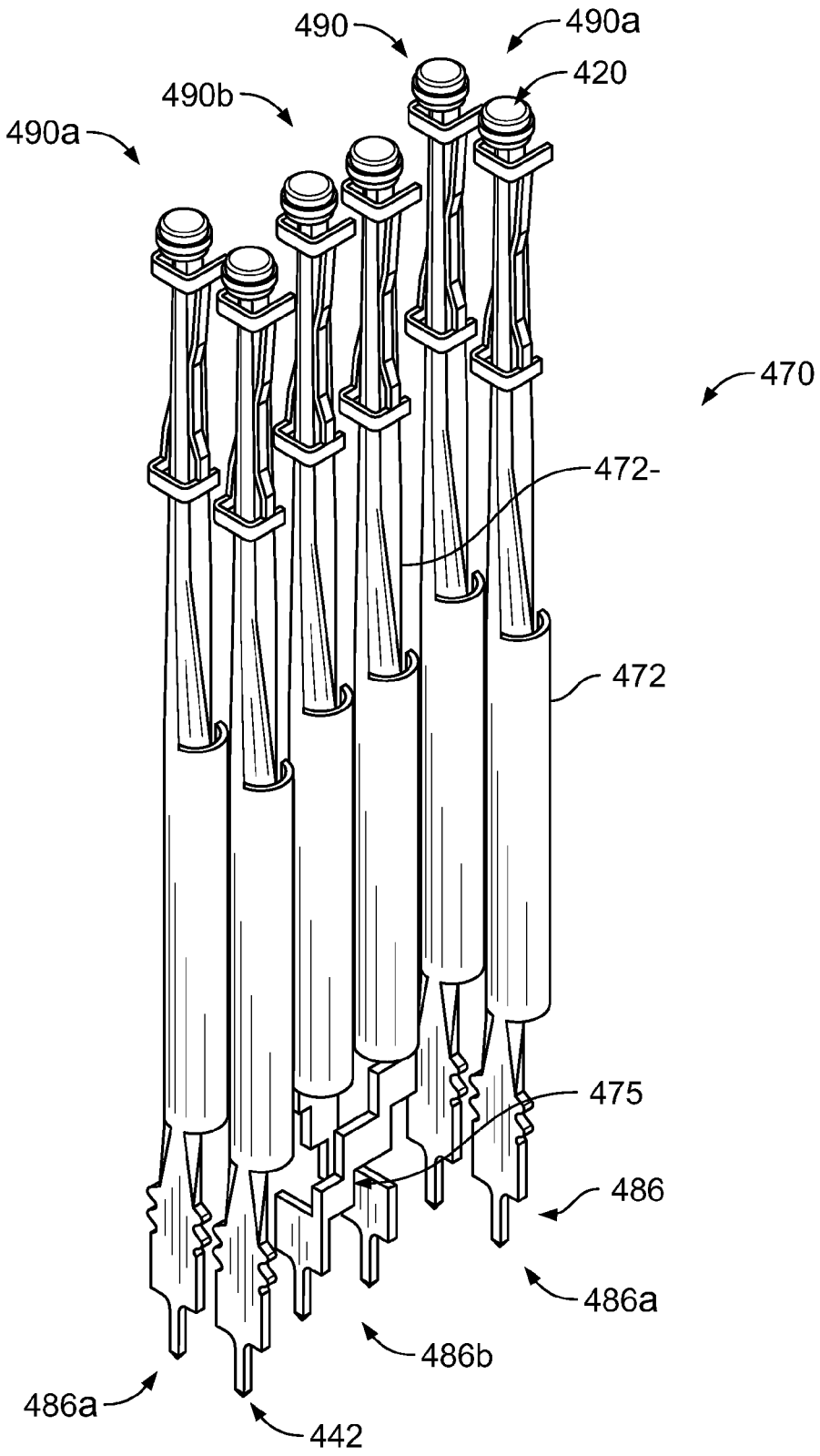
FIG. 7 is a perspective view of an exemplary embodiment of a lead frame of a contact module for use with the electrical connector shown in FIG. 1.

Moreover, although the connector 10 is described and illustrated herein as interconnecting electrical components that are approximately at a right angle to one another, the connector 10 may interconnect electrical components that are oriented at any other angle relative to each other. For example, FIG. 7 is a perspective view of an exemplary embodiment of a lead frame 470 that may be used with one of the contact modules 36 to generate patterns similar to the patterns 82 and 84 (FIG. 3). As can be seen in FIG. 7, the lead frame 470 is configured to interconnect electrical components, such as, but not limited to, circuit boards, that are oriented approximately parallel to each other.

The lead frame 470 includes a plurality of mounting contacts 442, a plurality of the mating contacts 420, and a plurality of terminals 472. Each terminal 472 interconnects a mounting contact 442 with the corresponding mating contact 420. Each of the mating contacts 420 and each of the mounting contacts 442 is optionally connected to the corresponding terminal 472 via a connector (not shown). The terminals 472 are arranged in differential pairs. Accordingly, the mounting and mating contacts 442 and 420, respectively, are arranged in differential pairs 486 and 490, respectively. Within each differential pair, one terminal 472 is selected as a positive terminal 472 while the other terminal 472 is selected as a negative terminal 472. Accordingly, within each differential pair 486, one mounting contacts 442 is a positive mounting contact 442 while the other is a negative mounting contact 442. Similarly, within each differential pair 490, one mating contact 420 is a positive mating contact 420 while the other is a negative mating contact 420.

The differential pairs 486 of mounting contacts 442 include two different groups 486*a* and 486*b* of differential pairs 486. Each of the differential pairs 486 within the differential pair group 486*a* is aligned approximately perpendicular to each of the differential pairs 486 within the differential pair group 486*b*. The differential pairs 490 of mating contacts 420 include two different groups 490*a* and 490*b* of differential pairs 490. Each of the differential pairs 490 within the differential pair group 490*a* is aligned approximately perpendicular to each of the differential pairs 490 within the differential pair group 490*b*.

Each differential pair 486 of mounting contacts 442 within the group 486*a* has a common orientation with the corresponding differential pair 490 of mating contacts 420 within the group 490*a*. However, the orientation of the positive and negative mounting contacts 442 of each differential pair 486 within the group 486*b* is inverted relative to the positive and negative mating contacts 420 of the corresponding differential pair 490 within the group 490*a*.

The mounting contacts 442, the mating contacts 420, and/or the terminals 472 of the differential pair group 486*b* include geometry that provides the corresponding mounting contacts 442 and mating contacts 420 of the differential pair group 486*b* with the inverted orientation. For example, in the exemplary embodiment, a negative terminal 472– of each differential pair of the group 486*b* include an angled portion 475 adjacent the corresponding mounting contact 442 that facilitates the inverted orientation. However, any of the mating contacts 420, the mounting contacts 442, and/or the terminals 472 (whether positive and/or negative) may include the geometry that facilitates providing the inverted orientation. Moreover, the geometry that facilitates providing the inverted orientation may be at any location(s) along the mating contacts 420, the mounting contacts 442, and/or the terminals 472 that enables the inverted orientation.

The mounting contacts 42, 142, and 442 may each be any suitable type of electrical contact that enables the mounting contacts 42, 142, and 442 to function as described herein, such as, but not limited to, a press-fit type, a surface mount type, and/or a solder tail type. The mating contacts 20, 120, and 420 may each be any suitable type of electrical contact that enables the mating contacts 20, 120, and 420 to function as described herein, such as, but not limited to, a press-fit type, a surface mount type, and/or a solder tail type.

Although the electrical connector 10 is described herein as interconnecting two electrical components using both the electrical connector 10 and a mating connector mounted on one of the electrical components, alternatively the electrical connector 10 directly interconnects the two electrical components without the mating connector intervening between one of the electrical components and the electrical connector 10.

While the electrical connector 10 is described and illustrated herein as receptacle connector having the contact cavities 22, it is to be understood that the benefits herein described are also applicable to other connectors in other embodiments. The description and illustration herein is therefore provided for purposes of illustration, rather than limitation, and is but one potential application of the subject matter described and/or illustrated herein.

The embodiments described and/or illustrated herein provide an electrical interconnection that may reduce far-end crosstalk generated by two circuit board footprints on either side of an electrical connector without reducing impedance, decreasing signal density, and/or increasing cost.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated has been described in terms of various specific embodiments, those skilled in the art will recognize that the subject matter described and/or illustrated can be practiced with modification within the spirit and scope of the claims.

What is claimed is:

1. A contact module for an electrical connector, said contact module comprising:

a body comprising a mating edge portion and a mounting edge portion; and a lead frame held by the body, the lead frame comprising a differential pair of terminals extending between the mating edge portion and the mounting edge portion, the differential pair comprising a positive terminal and a negative terminal having positive and negative mating contacts, respectively, and positive and negative mounting contacts, respectively, the positive and negative mating contacts extending from the mating edge portion in a first orientation relative to each other, the positive and negative mounting contacts extending from the mounting edge portion in a second orientation relative to each other, wherein the first orientation at the mating edge portion is inverted relative to the second orientation at the mounting edge portion.

2. The contact module according to claim 1, wherein the lead frame further comprises a second differential pair having positive and negative mating contacts and positive and negative mounting contacts, the positive and negative mating and mounting contacts of the second differential pair extending from the mating edge portion and the mounting edge portion, respectively, in a common orientation.

3. The contact module according to claim 1, wherein the lead frame further comprises a second differential pair having positive and negative mating contacts and positive and negative mounting contacts, the positive and negative mating contacts of the second differential pair extending from the mating edge portion in an orientation that is inverted relative to an orientation that the positive and negative mounting contacts of the second differential pair extend from the mounting edge portion.

4. The contact module according to claim 1, wherein the differential pair is a first group of a plurality of differential pairs, the lead frame further comprising a second group of differential pairs each having positive and negative mating contacts and positive and negative mounting contacts, the positive and negative mating and mounting contacts of each of the first group of differential pairs being aligned approximately perpendicular to the positive and negative mating and mounting contacts, respectively, of each of the second group of differential pairs, the positive and negative mating contacts of each of the second group of differential pairs extending from the mating edge portion in an orientation that is common with an orientation that the corresponding positive and negative mounting contacts of the second group of differential pairs extend from the mounting edge portion.

5. The contact module according to claim 1, wherein the differential pair is a first group of a plurality of differential pairs, the lead frame further comprising a second group of differential pairs each having positive and negative mating contacts and positive and negative mounting contacts, the positive and negative mating and mounting contacts of each of the first group of differential pairs being aligned approximately perpendicular to the positive and negative mating and mounting contacts, respectively, of each of the second group of differential pairs, the positive and negative mating contacts of each of the second group of differential pairs extending from the mating edge portion in an orientation that inverted relative to an orientation that the corresponding positive and negative mounting contacts of the second group of differential pairs extend from the mounting edge portion.

6. The contact module according to claim 1, wherein the differential pair is a first group of a plurality of differential pairs, the lead frame further comprising a second group of differential pairs each having positive and negative mating contacts and positive and negative mounting contacts, the positive and negative mating and mounting contacts of each of the first group of differential pairs being aligned approximately parallel to the positive and negative mating and mounting contacts, respectively, of each of the second group of differential pairs.

7. The contact module according to claim 1, wherein the differential pair is a first group of a plurality of differential pairs, the lead frame further comprising a second group of differential pairs each having positive and negative mating contacts and positive and negative mounting contacts, the positive and negative mating and mounting contacts of each of the first group of differential pairs being aligned approximately parallel to the positive and negative mating and mounting contacts, respectively, of each of the second group of differential pairs, the positive and negative mating contacts of each of the second group of differential pairs extending from the mating edge portion in an orientation that is common with an orientation that the corresponding positive and negative mounting contacts of the second group of differential pairs extend from the mounting edge portion.

8. The contact module according to claim 1, wherein the mating edge portion and the mounting edge portion are angled approximately perpendicular to each other or approximately parallel to each other.

9. The contact module according to claim 1, wherein the first orientation of the positive and negative mating contacts is inverted approximately 180° relative to the second orientation of the positive and negative mounting contacts.

10. A contact module for an electrical connector, said contact module comprising:

a body comprising a mating edge portion and a mounting edge portion; and a lead frame held by the body, the lead frame comprising a first group of a plurality of differential pairs of terminals extending between the mating edge portion and the mounting edge portion, each differential pair of the first group of differential pairs comprising a positive terminal and a negative terminal having positive and negative mating contacts, respectively, and positive and negative mounting contacts, respectively, the positive and negative mating contacts extending from the mating edge portion in a first orientation, the positive and negative mounting contacts extending from the mounting edge portion in a second orientation, wherein the first orientation at the mating edge portion is inverted relative to the second orientation at the mounting edge portion, the lead frame further comprising a second group of differential pairs each having positive and negative mating contacts and positive and negative mounting contacts, the positive and negative mating and mounting contacts of each of the first group of differential pairs being aligned approximately perpendicular to the positive and negative mating and mounting contacts, respectively, of each of the second group of differential pairs.

11. An electrical connector comprising:

a housing comprising a mating face and a mounting face; and a differential pair of terminals extending between the mating face and the mounting face, the differential pair comprising a positive terminal and a negative terminal having positive and negative mating contacts, respectively, and positive and negative mounting contacts, respectively, the positive and negative mating contacts extending from the mating face in a first orientation relative to each other, the positive and negative mounting contacts extending from the mounting face in a second orientation relative to each other, wherein the first orientation at the mating face is inverted relative to the second orientation at the mounting face.

12. The electrical connector according to claim 11, further comprising a second differential pair having positive and negative mating contacts and positive and negative mounting contacts, the positive and negative mating and mounting contacts of the second differential pair extending from the mating face and the mounting face, respectively, in a common orientation.

13. The electrical connector according to claim 11, further comprising a second differential pair having positive and negative mating contacts and positive and negative mounting contacts, the positive and negative mating contacts of the second differential pair extending from the mating face in an orientation that is inverted relative to an orientation that the positive and negative mounting contacts of the second differential pair extend from the mounting face.

14. The electrical connector according to claim 11, wherein the differential pair is a first group of a plurality of differential pairs, the electrical connector further comprising a second group of differential pairs each having positive and negative mating contacts and positive and negative mounting contacts, the positive and negative mating and mounting contacts of each of the first group of differential pairs being aligned approximately perpendicular to the positive and negative mating and mounting contacts, respectively, of each of the second group of differential pairs.

15. The electrical connector according to claim 11, wherein the differential pair is a first group of a plurality of differential pairs, the electrical connector further comprising a second group of differential pairs each having positive and negative mating contacts and positive and negative mounting contacts, the positive and negative mating and mounting contacts of each of the first group of differential pairs being aligned approximately perpendicular to the positive and negative mating and mounting contacts, respectively, of each of the second group of differential pairs, the positive and negative mating contacts of each of the second group of differential pairs extending from the mating face in an orientation that is common with an orientation that the corresponding positive and negative mounting contacts of the second group of differential pairs extend from the mounting face.

16. The electrical connector according to claim 11, wherein the differential pair is a first group of a plurality of differential pairs, the electrical connector further comprising a second group of differential pairs each having positive and negative mating contacts and positive and negative mounting contacts, the positive and negative mating and mounting contacts of each of the first group of differential pairs being aligned approximately perpendicular to the positive and negative mating and mounting contacts, respectively, of each of the second group of differential pairs, the positive and negative mating contacts of each of the second group of differential pairs extending from the mating face in an orientation that inverted relative to an orientation that the corresponding positive and negative mounting contacts of the second group of differential pairs extend from the mounting face.

17. The electrical connector according to claim 11, wherein the differential pair is a first group of a plurality of differential pairs, the electrical connector further comprising a second group of differential pairs each having positive and negative mating contacts and positive and negative mounting contacts, the positive and negative mating and mounting contacts of each of the first group of differential pairs being aligned approximately parallel to the positive and negative mating and mounting contacts, respectively, of each of the second group of differential pairs.

18. The electrical connector according to claim 11, wherein the differential pair is a first group of a plurality of differential pairs, the electrical connector further comprising a second group of differential pairs each having positive and negative mating contacts and positive and negative mounting contacts, the positive and negative mating and mounting contacts of each of the first group of differential pairs being aligned approximately parallel to the positive and negative mating and mounting contacts, respectively, of each of the second group of differential pairs, the positive and negative mating contacts of each of the second group of differential pairs extending from the mating face in an orientation that is common with an orientation that the corresponding positive and negative mounting contacts of the second group of differential pairs extend from the mounting face.

19. The electrical connector according to claim 11, wherein the mating face and the mounting face are angled approximately perpendicular to each other or approximately parallel to each other.

20. The electrical connector according to claim 11, wherein the first orientation of the positive and negative mating contacts is inverted approximately 180° relative to the second orientation of the positive and negative mounting contacts.

* * * * *